United States Patent [19]

Johdai et al.

[11] Patent Number: 4,814,825

[45] Date of Patent: Mar. 21, 1989

[54] MULTIPLE SPEED SHEET INVERTING AND DISCHARGE

[75] Inventors: Akiyoshi Johdai; Keichi Kinoshita, both of Toyokawa; Kazuyuki Kubota, Yamanashi; Toshio Matsui; Hirokazu Yamada, both of Toyohashi; Masaya Ohta, Yamanashi, all of Japan

[73] Assignee: Minolta Camera Kabushiki Kaisha, Osaka, Japan

[21] Appl. No.: 60,251

[22] Filed: Jun. 9, 1987

[30] Foreign Application Priority Data

| | | | |
|---|---|---|---|
| Jun. 13, 1986 | [JP] | Japan | 61-137461 |
| Jun. 13, 1986 | [JP] | Japan | 61-137462 |
| Jun. 14, 1986 | [JP] | Japan | 61-138652 |
| Jun. 14, 1986 | [JP] | Japan | 61-138653 |

[51] Int. Cl.[4] ..... G03G 15/00; B65H 29/00; B65H 7/02

[52] U.S. Cl. ..... 355/14 SH; 355/3 SH; 271/186; 271/265; 271/902

[58] Field of Search ..... 355/3 SH, 14 SH, 3 R, 355/23, 24, 25; 271/202, 203, 902, 265, 186, 184, 3.1, 303, 304

[56] References Cited

U.S. PATENT DOCUMENTS

| | | | |
|---|---|---|---|
| 3,833,911 | 9/1974 | Caldwell et al. . | |
| 4,300,757 | 11/1981 | Koiso et al. . | |
| 4,453,819 | 6/1984 | Wada et al. | 355/3 SH |
| 4,537,497 | 8/1985 | Masuda . | |
| 4,561,767 | 12/1985 | Aoki et al. | 355/3 SH X |
| 4,571,056 | 2/1986 | Tani et al. | 355/3 SH X |
| 4,579,327 | 4/1986 | Furaichi | 271/202 X |
| 4,629,173 | 12/1986 | Hashimoto et al. | 355/3 SH X |
| 4,657,238 | 4/1987 | Nishikawa . | |
| 4,667,951 | 5/1987 | Honjo et al. | 271/3.1 |
| 4,669,717 | 6/1987 | Yamashita et al. . | |

FOREIGN PATENT DOCUMENTS 61-2655 1/1986 Japan .

*Primary Examiner*—A. T. Grimley
*Assistant Examiner*—Ed Pipala
*Attorney, Agent, or Firm*—Burns, Doane Swecker & Mathis

[57] ABSTRACT

A sheet storing apparatus capable of discharging sheets supplied by an image forming apparatus either face-up or face-down. The sheet storing apparatus comprises: forward/reverse rotary rollers for delivering a sheet in a direction leaving the image forming apparatus behind as well as in a direction contrary to the former, sheet discharging rotary rollers for discharging the sheet out of the sheet storing apparatus on a storing tray, a first delivery path for discharging the sheet face-up, a second delivery path for delivering the sheet in the direction leaving the image forming apparatus behind, a third delivery path for discharging the sheet face-down, switching guides for diverting the sheet either to the first or second delivery path, a sheet detecting sensor, disposed on a common path formed by joining the first and third paths, for detecting the sheet, a discharge mode controller for selecting either the face-up discharge mode or the face-down discharge mode according to sheet detections by said sheet detecting sensor, and a rotatable top cover for supporting components of said delivery paths' guide surfaces and said switching guides and for exposing said delivery paths.

12 Claims, 11 Drawing Sheets

MULTIPLE SPEED SHEET INVERTING AND DISCHARGE

BACKGROUND OF THE INVENTION

1. Field of the Invention

The present invention relates to a sheets storing apparatus for storing sheet, discharged from an image forming apparatus, with its image formed surface upward (face-up) or downward (face-down).

2. Description of Related Art

The Japanese Laid-open Patent No. Sho 61-2655 discloses a sheet storing apparatus, which is attached to a sheet discharge portion of a copying machine, and which stores sheets discharged from the copying machine with its copied surface upward in a face-up mode and with its copied surface downward in a face-down mode.

The sheet storing apparatus described above comprises forward/reverse rotation rollers rotatable in both forward and reverse directions which are disposed on a sheet delivery path. Sheet discharged from the copying machine are moved forward at first by the forward rotation of the forward/reverse rotation roller, and then moved backward to feed-out rollers. More specifically, the forward/reverse rotary rollers are controlled to rotate in the forward direction to take in the next sheet after the preceding sheet has been moved backwards and released from the forward/reverse rotary rollers. Thus, the sheets being delivered are successively turned over.

The conventional sheet storing apparatus has the following problems:

If an interval between delivered sheets on which images are formed or copied, namely an interval between the preceding sheet and the next sheet, is short, sheet jamming is liable to occur because the next sheet is accidentally taken in by the feed-out rollers, or because the preceding sheet is taken in by the forward-/reverse rollers before it has been released form the discharge rollers.

Switching to a desired control program can not be properly done. Micro switch a switching lever for actuating a mode selection switch is placed halfway. Since the switching to a desired control program is normally done after detecting on or off state of the switch interlocking with the switching lever when selectively switching two different control programs for the face-up discharge mode and the face-down discharge mode.

Moreover, it is hard to remove jammed sheets from the conventional apparatus.

SUMMARY OF THE PRESENT INVENTION

Accordingly, it is an object of the present invention to solve above mentioned problems and provide a sheet storing apparatus capable of storing sheets in a well arranged manner with face-up and face-down even if the interval between the sheets supplied by the image forming apparatus is short.

It is another object of the present invention to solve the above mentioned problems and provide a sheet storing apparatus capable of switching two different control programs for the face-up discharge mode and the face-down discharge mode easily and without failure.

It is another object of the present invention to provide a sheet storing apparatus capable of turning the sheets over at a faster speed without failure.

It is another object of the present invention to provide a sheet storing apparatus in which jammed sheets can be removed easily.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
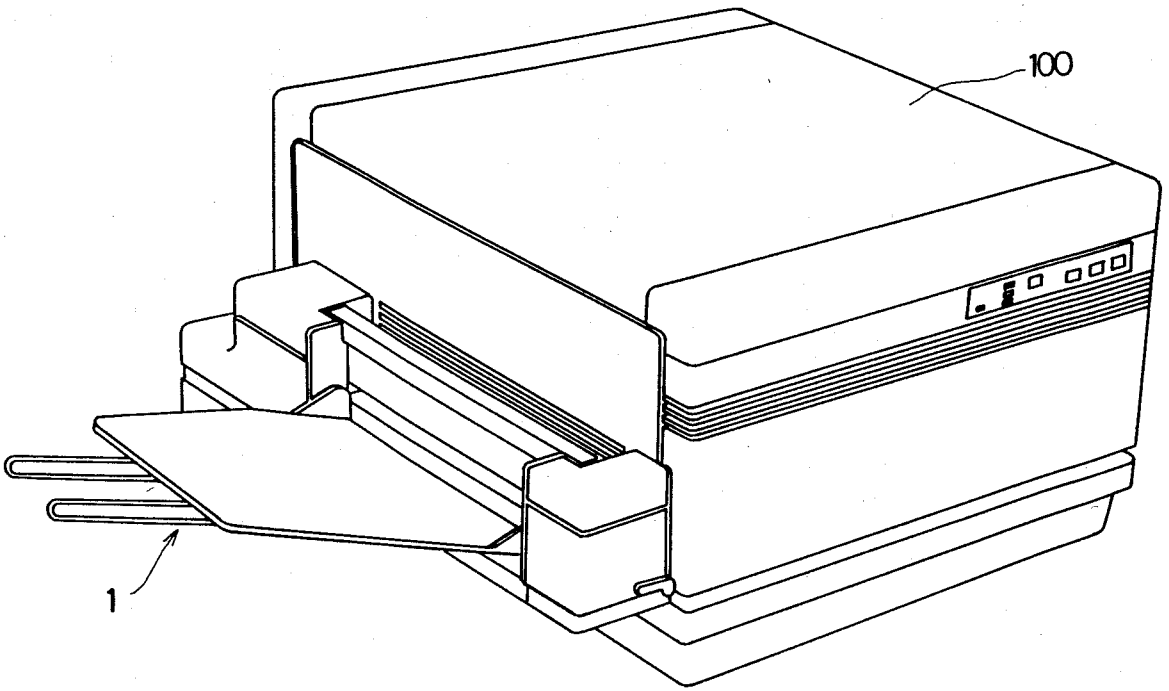
FIG. 1 illustrates a general view of the sheet storing apparatus, according to the present invention, installed on a laser printer.
Figure 2:
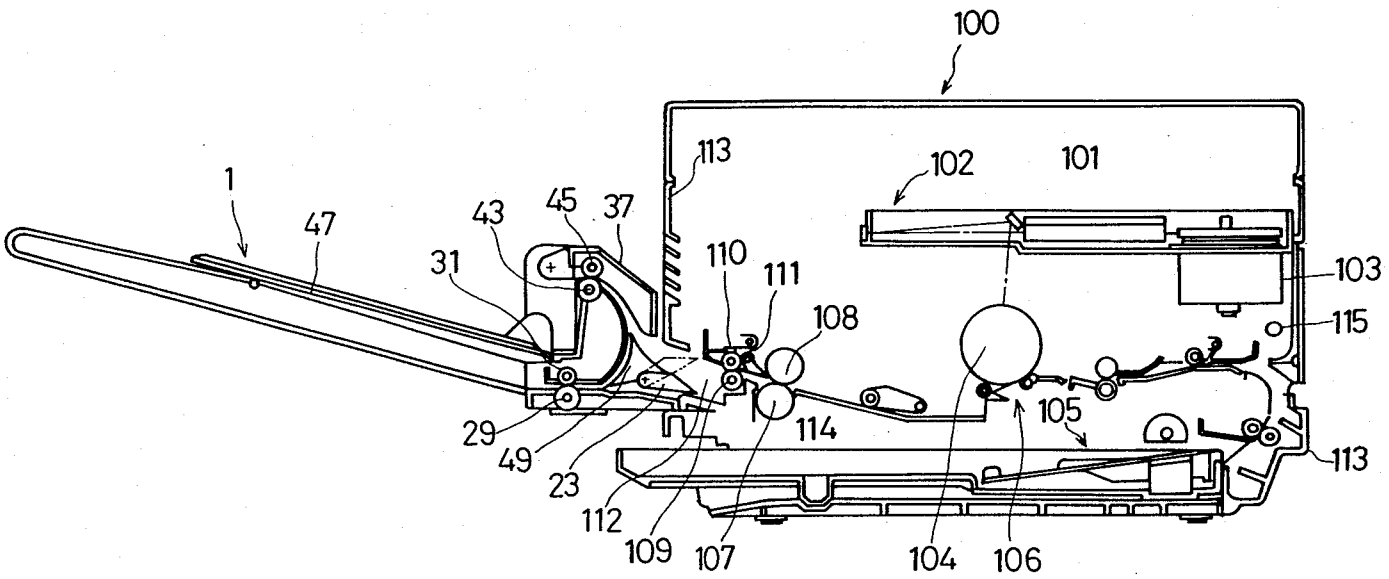
FIG. 2 illustrates a schematic sectional view of the sheet storing apparatus according to the present invention and the laser printer.

FIG. 1 illustrates a general view of a sheet storing apparatus, according to the present invention, installed on a laser printer. FIG. 2 illustrates a schematic sectional view of the sheet storing apparatus and the laser printer. Referring to FIG. 2, a printer main body 100 has an upper unit 101 and a lower unit 114. The upper unit has a laser optical system 102, a laser optical system driver 103, a photosensitive drum 104, an upper fixing roller 108, an upper sheet discharging roller 110, a sheet discharge sensor 111, and an upper cover 113 enclosing the formers. The lower unit 114 has a sheet supplying unit 105, a transferring/separating unit 106, a lower fixing roller 107, and a lower cover 113' enclosing the formers. The upper unit 101 and the lower unit 114 are swingable around a unit shaft 115.

Figure 3:
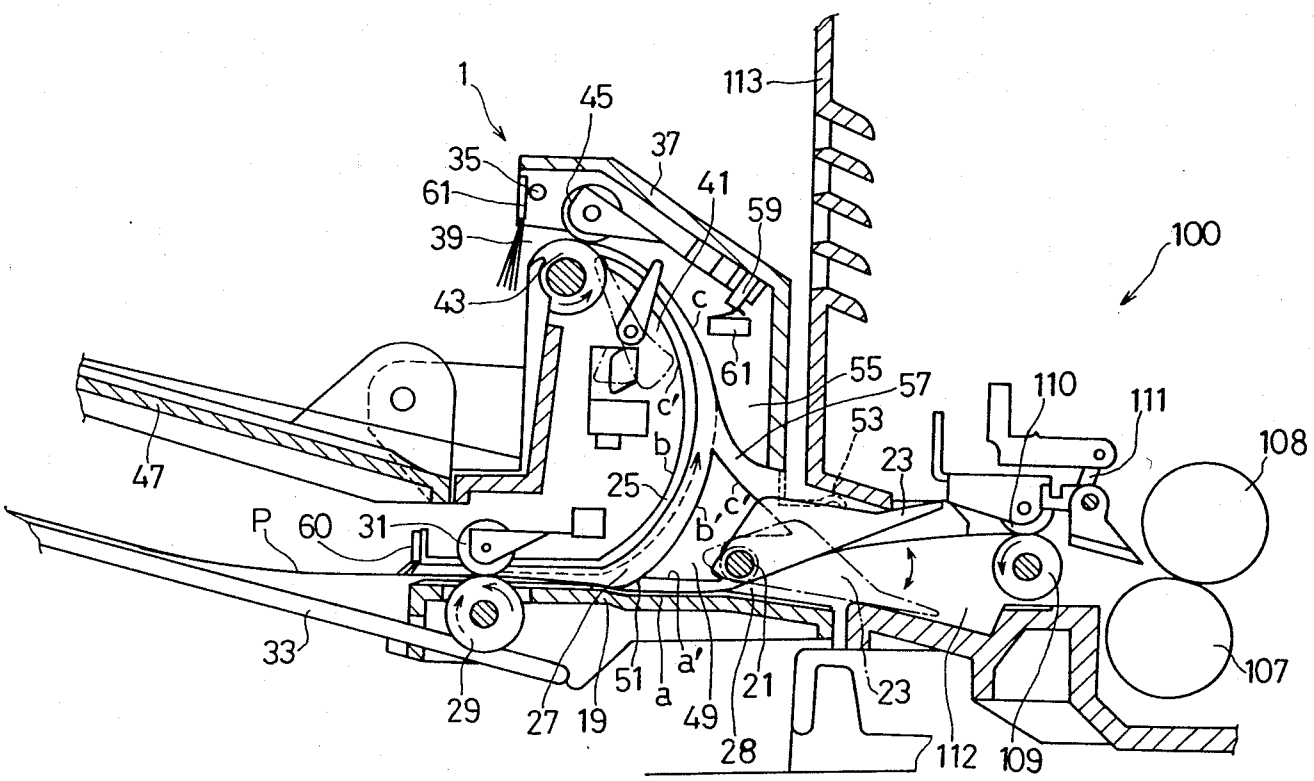
FIG. 3 is a sectional view illustrating main portions of the sheet storing apparatus set for the face-down discharge mode.
Figure 4:
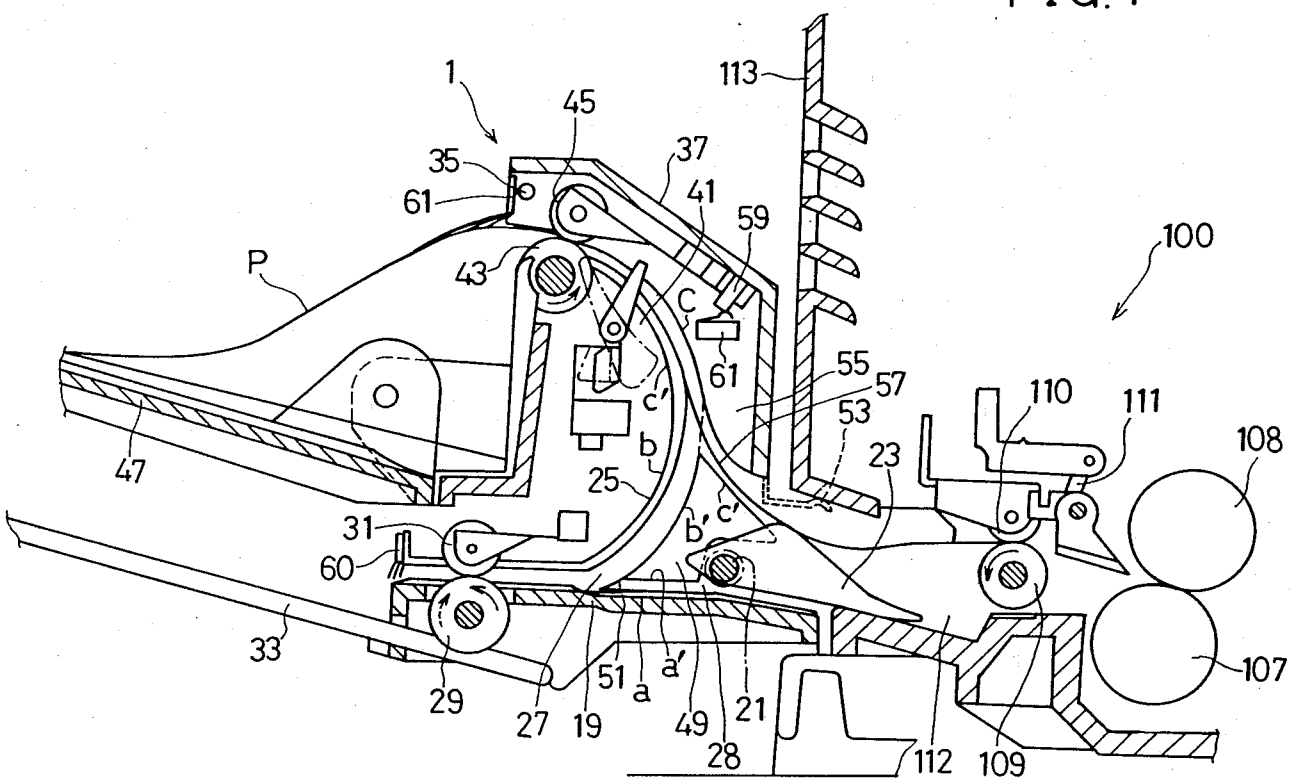
FIG. 4 is a sectional view illustrating main portions of the sheet storing apparatus set for the face-up discharge mode.

As illustrated in FIGS. 3 and 4, the sheet storing apparatus 1 has a construction to discharge sheets, supplied by the printer main body 100, to a sheet storing unit selectively with its image formed or copied surfaces upwards (hereinafter referred to as "face-up"), or downwards (hereinafter referred to as "face-down").

The sheet storing apparatus 1 is installed on a sheet discharge opening 112 of the printer main body 100. The sheet storing apparatus 1 has a base 19 forming a guide surface "a" which is one of the guide surfaces of a second delivery path 28 connected to a third delivery path 27 for turning the sheets over, switching guides 23, which swing around a shaft 21, for switching delivery direction of the sheets supplied from the sheet discharge opening 112 either to a first delivery path 57 or the second delivery path 28, auxiliary guides 49 forming a guide surface "b'" which is one of guide surfaces of the third delivery path 27 for turning sheets over, a turning over guide 25 for turning sheets' face and reverse surfaces over, which is disposed on the downstream second delivery path 28, forward/reverse rotary driving rollers 29 provided at the base 19 rotatably in forward and reverse following rollers provided at the guide 25 and each pressed against each roller 29, a support frame 33, removable from the base 19, for supporting sheets delivered out of the forward/reverse rotary driving rollers 29 and the following rollers 31, a top cover 37 swinging around a shaft 35 and having a component forming a guide surface "c" which is one of guide surfaces of the first delivery path 57, a sheet discharge sensor 41 having a lever and a photo interrupter, which is disposed behind a discharge opening 39, feed-out driving rollers 43 and following rollers 45, which are pressed against each other and are disposed on the discharge opening 39, and a removable tray 47 for storing sheets discharged out of the discharge opening 39.

Said base 19 may be constructed integrally with the auxiliary guides 49 forming guide surfaces "a'", "b'" and "c'" which are the other guide surfaces of the first delivery path 57, the second delivery path 28 and the third delivery path 27.

Figure 5:
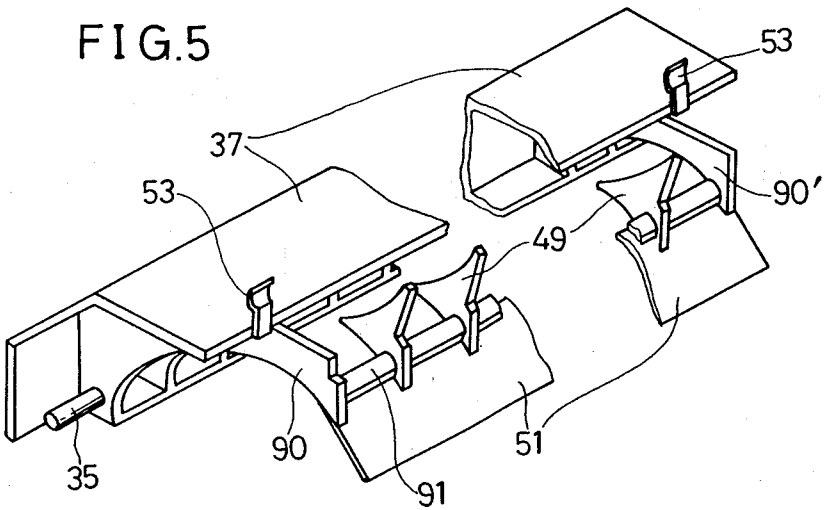
FIG. 5 is a partially cutaway perspective illustration showing the construction of the top cover of the sheet storing apparatus according to the present invention.

As illustrated in FIG. 5, the auxiliary guides 49 are installed on a supporting component 91 at an interval. The supporting component 91 is fixed on side plates 90 and 90' extending from the top cover 37. An elastic sheet 51, such as a synthetic resin sheet, is so fixed along the longitudinal direction of the supporting component 91 as to form an extended side of the each auxiliary guide 49.

Turning now to FIGS. 3 or 4, the first delivery path 57 (or a face-up discharge path) for discharging sheets with their faces facing upwards is formed between the guide surface "c'" of the auxiliary guides 49 and the guide surface "c" of a delivery guide 55. The first delivery path 57 is connected in an acute angle to the third delivery path 27 (or a face-down discharge path) for turning sheets over.

Figure 6:
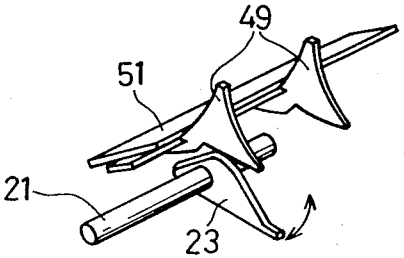
FIG. 6 is a partially cutaway perspective illustration showing the construction of the switching means of the sheet storing apparatus according to the present invention.

As illustrated in FIG. 6, the auxiliary guide 49 is disposed on the downstream side of the switching guide 23, and combined with the switching guide 23. The auxiliary guide 49 has guide surfaces for introducing sheets to a desired path smoothly, and works as a guide for guiding the sheets. In this embodiment, the switching means is illustrated as a constitution of two components, i.e., the switching guide 23 and the auxiliary guide 49, but it is not limited to the constitution.

Still referring to FIG. 6, the switching guides 23 are installed on the shaft 21. The switching guide 23 and the auxiliary guide 49 are made in a pair, and the pairs are installed in comb shape. The switching guide 23 overlaps with the auxiliary guide 49. And the switching guide 23 and the auxiliary guide 49 are disposed alternately, and form a guide surface for delivering sheets smoothly.

As shown in FIG. 5, the top cover 37 has the auxiliary guides 49 and the elastic sheet 51 on a periphery of the swinging top cover 37. The shaft 35 of the top cover 37 is disposed near the following rollers 45 or further downstream side from the following rollers 45 as illustrated in FIG. 3 or 4. Thus the top cover 37 can be swung in the counter clockwise direction to expose the delivery paths.

When the upper cover 113 of the printer main body 100 is closed, the top cover 37 is locked with the upper cover 113 by a spring lever 53 installed on the top cover as illustrated in FIG. 5. Turning now to FIGS. 3 or 4, a micro switch 61 fixed on a side frame (not shown) is actuated by a boss 59 installed on the top cover 37. Thus the micro switch 61 is turned on and off by opening and closing the top cover 37. Accordingly, it can be detected whether the top cover 37 is opened or closed.

Figure 7:
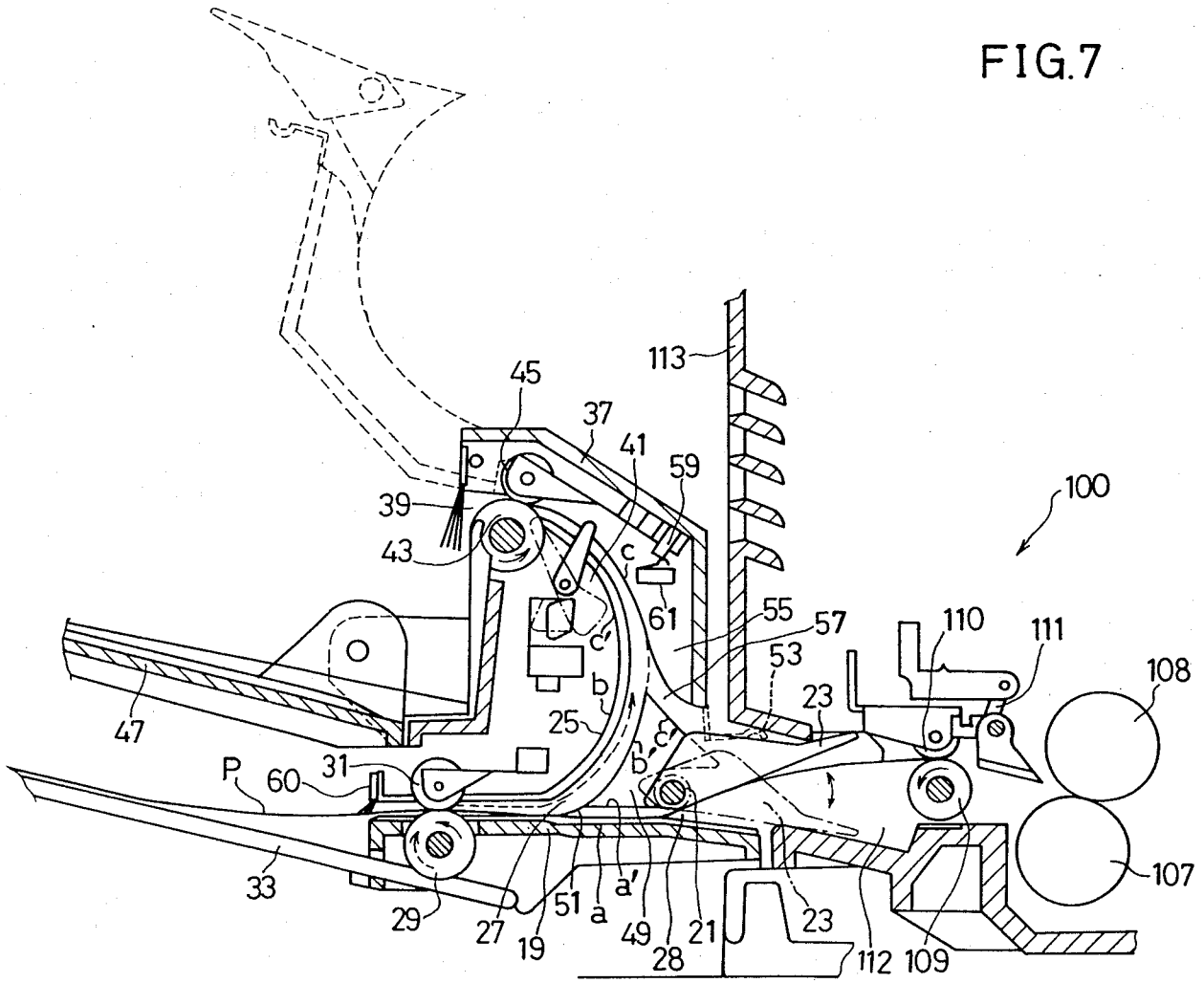
FIG. 7 is a schematic sectional view illustrating the swung open top cover.

As described above, the top cover 37 can swing to the position specified by the chain line in FIG. 7 to expose the delivery paths. Because the auxiliary guides 49 and the elastic sheet 51 swing with the top cover 37, the third delivery path 27 and the elastic sheet 51 can also be exposed. Therefore, when sheet jamming has occurred, operators can visually identify a location, where the sheet jamming occurs, with ease.

Referring to FIGS. 3 or 4 again, the sheet discharge sensor 41 comprising a lever and a photo interrupter is disposed on a common delivery path formed by joining the third delivery path 27 for discharging the sheets face-down (turning the image formed or copied surface downwards) and the first delivery path 57 for discharging the sheets face-up (facing the image formed or copied surface upwards).

Figure 12:
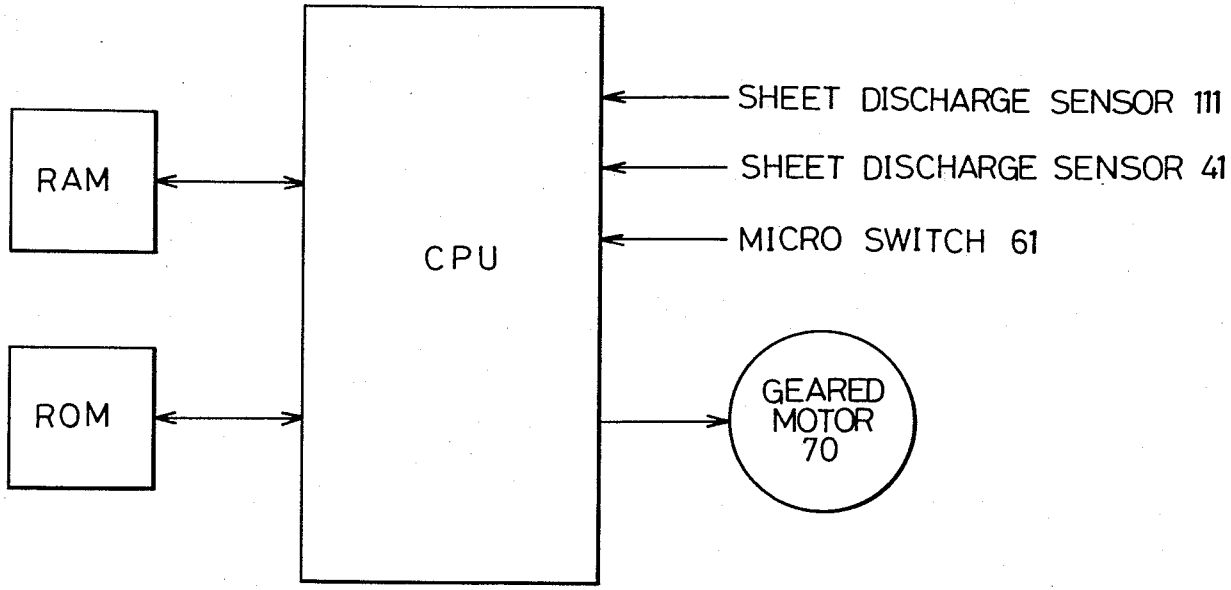
FIG. 12 is a schematic block diagram illustrating the discharge mode control means construction of the sheet storing apparatus according to the present invention.

As later described, a discharge mode control means shown in FIG. 12 selects the face-up discharge mode if the sheet, supplied by the printer main body 100, is detected by the sheet discharge sensor 41 after a delivery time has passed, namely after the sheet has been introduced to the first delivery path 57 and detected by the sheet discharge sensor 41, and the discharge mode control means selects the face-down discharge mode if the sheet is not detected by the discharge sensor 41.

The forward/reverse rotary driving rollers 29 and the feed-out driving rollers 43 are driven by a single motor. The forward/reverse rotary driving rollers 29 rotate in the forward and reverse directions, but the feed-out driving rollers 43 rotate only in one direction. This driving mechanism will be explained by referring to FIG. 8.

Figure 8:
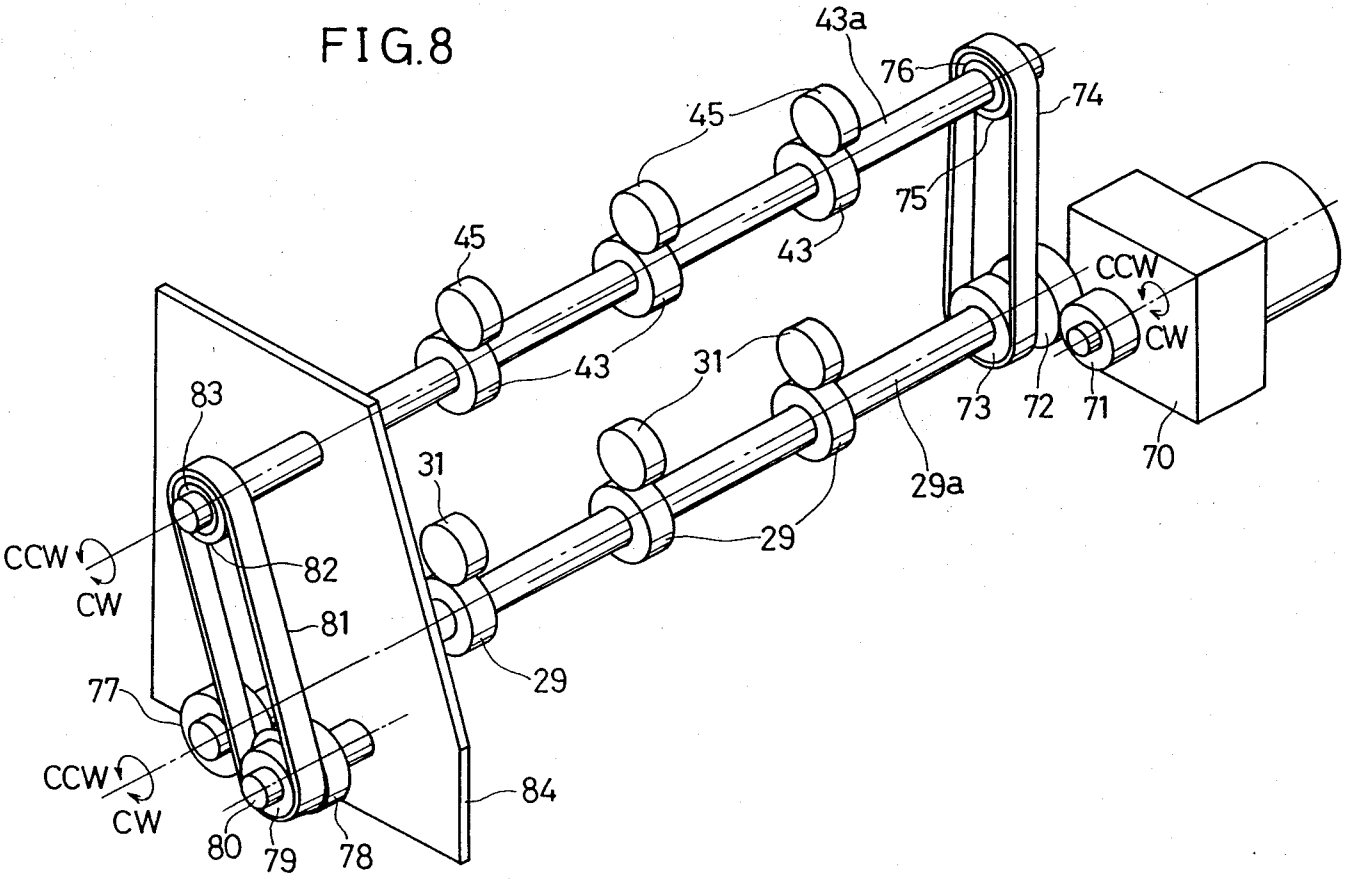
FIG. 8 is a schematic perspective illustration for explaining the driving mechanism of the forward/reverse rotary rollers and the feed-out rollers.

FIG. 8 is a schematic perspective illustration for explaining the driving mechanism for rollers. A pulley 73 and a gear 72 are fixed on an end of a driving shaft **29*a* of the forward/reverse rotary driving rollers 29. The gear 72 is in mesh with an output gear 71 of a geared motor 70**.

A pulley 75 is installed on an end of a rotary shaft **43*a* of the feed-out driving rollers 43 with a one-way bearing 76 disposed in there-between. A belt 74 is installed between the pulley 75 and the pulley 73**.

A gear 77 is fixed on the other end of the driving shaft **29*a* of the forward/reverse rotary driving rollers 29. The gear 77 is in mesh with an idle gear 78 rotatably supported by a shaft 80 fixed on a side plate 84 by crimping. The idle gear 78 is equipped with a pulley 79. A belt 81 is installed between the pulley 79 and a pulley 82 installed on an end of the rotary shaft 43*a* of the feed-out driving rollers 43 with a one-way bearing 83** disposed in between.

When the geared motor 70 rotates in the clockwise direction (forward or right rotation, hereinafter referred to as "CW" direction), the forward/reverse rotary driving rollers 29 are rotated in the counter clockwise direction (reverse or left rotation, hereinafter referred to as "CCW" direction), in which the sheet is drawn in. The pulley 82 is rotated in the CW direction by a driving force transmitted through the gear 77, the idle gear 78, the pulley 79 and the belt 81. But the driving force is not transmitted to the rotary shaft 43*a* of the feed-out driving rollers 43 because the one-way bearing 83 is installed so as to idly rotate between the pulley 82 and the rotary shaft 43*a* of the feed-out driving rollers 43. However, the feed-out driving rollers 43 are rotated in the CCW direction because the one-way bearing 76 is installed on the other end of the rotary shaft 43*a* of the feed-out driving rollers 43 so as to rotate the rotary shaft 43*a* in the CCW direction.

When the geared motor 70 rotates in the CCW direction, the forward/reverse rotary driving rollers 29 are rotated in the CW direction, in which the sheet is moved backwards. In this case, the feed-out driving rollers 43 are also rotated in the CCW direction because the one-way bearing 83 is installed so as to rotate the pulley 82 in the CCW direction. On the other hand, the pulley 75 is subjected to a driving force rotating itself in the CW direction, but in this case the one-way bearing 76 is installed on the other end of the rotary shaft 43*a* of the feed-out driving rollers 43 so as to idly rotate. Accordingly, the driving force is not transmitted to the rotary shaft 43*a* of the driving rollers 43.

Figure 9:
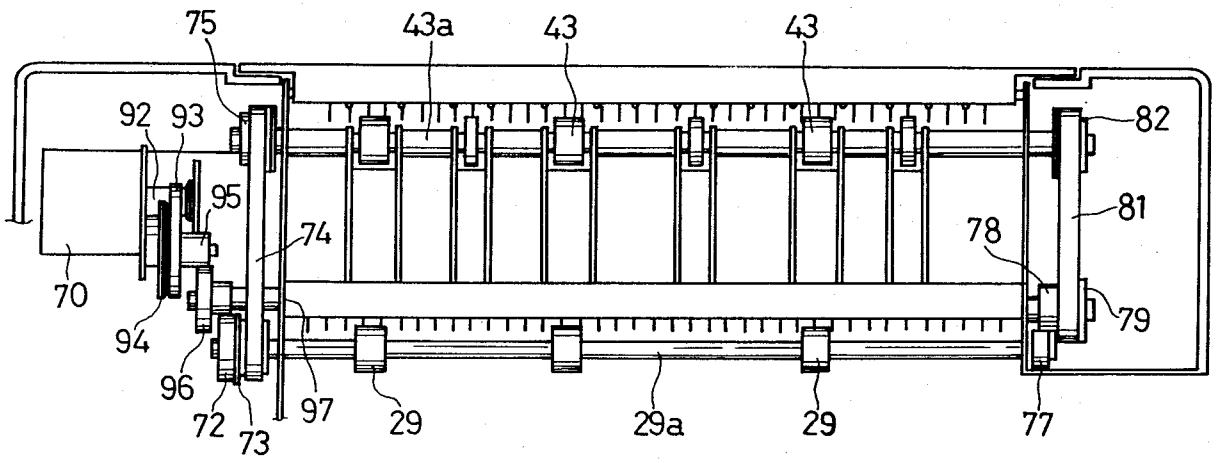
FIG. 9 is a front view of the modified embodiment for the driving mechanism of the forward/reverse rotary rollers and the feed-out rollers.

FIG. 9 is a front view of another embodiment of the forward/reverse rotary rollers and the feed-out rollers driving mechanism. This mechanism works as follows: the forward/reverse rotary driving rollers 29 and the feed-out driving rollers 43 are driven by a single motor 70' as shown in the figure. The motor 70' rotates the driving shaft 29*a* of the forward/reverse driving rollers 29 via a pulley 92, a timing belt 93, a pulley 94, and gears 95, 96, 97 and 72, and transmits a driving force to the rotary shaft 43*a* of the feed-out driving rollers 43 via the pulley 73, a timing belt 74' and the pulley 75. However, the rotary shaft 43*a* of the feed-out driving rollers 43 rotate only in the direction discharging the sheet when the timing belt 74' is driven in an arrow direction specified by the full line in FIG. 9, because a one-way clutch (not shown) is disposed between the rotary shaft 43*a* of the feed-out driving rollers 43 and the pulley 75. The other end of the driving shaft 29*a* of the forward/reverse rotary driving rollers 29 and the rotary shaft 43*a* of the feed-out driving rollers 43 are interlocked by the gears 77 and 78, the pulley 79, a timing belt 81', and the pulley 82. The rotary shaft 43*a* of the feed-out driving rollers 43 rotates only in the direction discharging the sheet even when the timing belt 81' is driven in an arrow direction specified by the chain line in FIG. 9 because a one-way clutch (not shown) is disposed between the rotary shaft 43*a* of the feed-out driving rollers 43 and the pulley 82.

The mechanisms thus constructed rotate the feed-out driving rollers 43 only in the CCW direction as illustrated in FIG. 8 when the geared motor 70 rotates either in the CW or CCW direction.

A sheet delivery force induced by the feed-out driving rollers 43 and the feed-out driven rollers 45 is set to be greater than a sheet delivery force induced by the forward/reverse rotary driving rollers 29 and the forward/reverse rotary driven rollers 31, i.e., (the sheet delivery force induced by the feed-out driving rollers 43 and the feed-out driven rollers 45)>(the sheet delivery force induced by the forward/reverse rotary driving rollers 29 and the forward/reverse rotary driven rollers 31). The delivery forces are expressed in the products of forces pressing the rollers and relative coefficients of friction between the sheet and the rollers. Furthermore, the relative coefficient of friction between the forward/reverse rotary driving rollers 29 and the sheet is set to be greater than the relative coefficient of friction between the sheets.

Operations of the sheet storing apparatus, according to the present invention, constructed as described above will be explained as follows.

(Discharge Mode Selection)

A lever (not shown) installed on the shaft 21 (See FIGS. 3 or 4) is turned to switch the switching guides 23 for the face-down discharge mode or the face-up up discharge mode. Thus, the face-down discharge path or the face-up discharge path is selected.

(Face-down Discharge Mode)

Figure 10:
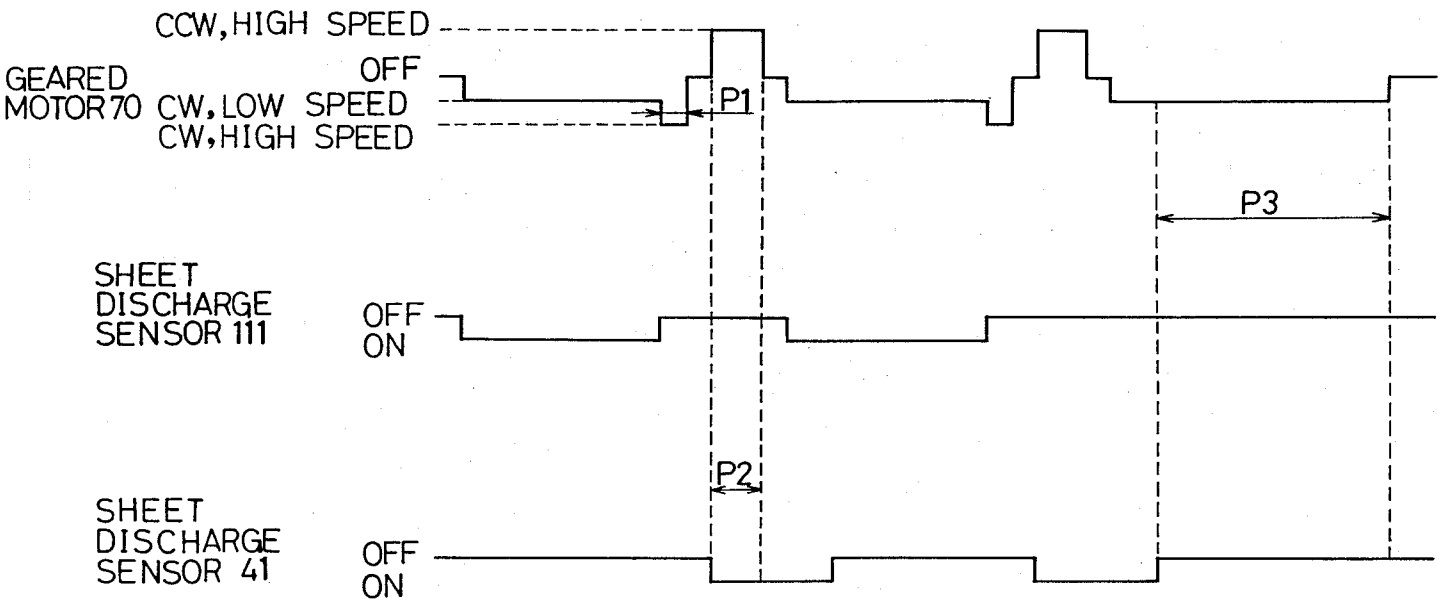
FIG. 10 is a face-down discharge mode timing chart.

A setting of the sheet storing apparatus for the face-down discharge mode is illustrated in FIG. 3. A face-down discharge mode timing chart is shown in FIG. 10.

The switching guides 23 are turned upwards as shown in FIG. 3 to switch the discharge mode to the face-down discharge mode for discharging the sheet P face-down.

When the sheet P, copied by the printer main body 100, with its copied surface facing upwards and delivered through the lower fixing roller 107 and the upper fixing roller 108, is detected by the sheet discharge sensor 111, the geared motor 70 of the sheet storing apparatus 1 shown in FIG. 8 is started to rotate in the CW direction. Consequently, the forward/reverse rotary driving rollers 29 and the feed-out driving rollers 43 are rotated in the CCW direction as shown in FIG. 8.

The speed of the forward/reverse rotary driving rollers 29 is controlled to a first speed, i.e., a low speed (LOW). The sheet P delivered by the lower and upper sheet discharging rollers 109 and 110, whose copied surface always faces upwards at this moment, is guided to the lower surfaces of the switching guides 23, and delivered through the second delivery path 28 formed between the elastic sheet 51 and the base 19. And then, the sheet P is held between the forward/reverse rotary driving rollers 29 and the follower rollers 31, and delivered to the support frame 33.

The sheet delivery at the low speed continues until the rear end of the sheet P is detected by the sheet discharge sensor 111. The sheet discharge sensor 41 is checked whether it is turned on or off at the same time the discharge sensor 111 detects the rear end of the sheet P. In the face-down mode, the sheet discharge sensor 41 detects the rear end of the sheet P. Hence, the switching guides 23 are checked whether they are set for the face-up discharge mode or the face-down discharge mode.

When the sheet discharge sensor 41 is found that it is turned off, namely the switching guides 23 are set for the face-down discharge mode, the speed of the geared motor 70 is increased to drive the forward/reverse rotary driving rollers 29 at a second speed which is faster than the first speed.

The geared motor 70 is rotated at the second speed for a predetermined time Pl as shown in FIG. 10. After an interval between the preceding sheet and the next sheet has been enlarged in this manner, the geared motor 70 is stopped temporarily. At this moment, the rear end of the sheet P is placed between the forward-/reverse rotary driving rollers 29 and the elastic sheet 51.

Next, the geared motor 70 is rotated in the CCW direction. The forward/reverse rotary driving rollers 29 are rotated in the CW direction as specified by an arrow of the chain line in FIG. 3 to move the sheet P backwards. The sheet P is guided along the elastic sheet 51, and introduced to the third delivery path 27 for the face-down discharge. To put it differently, the sheet P is guided to the third delivery path 27 while contacting with the elastic sheet 51, the turning over guide surfaces "b'" of the auxiliary guides 49, and the guide surface "c" of the delivery guide 57 inner wall. The formerly rear end of the sheet P is now turned into the front end.

Figure 11:
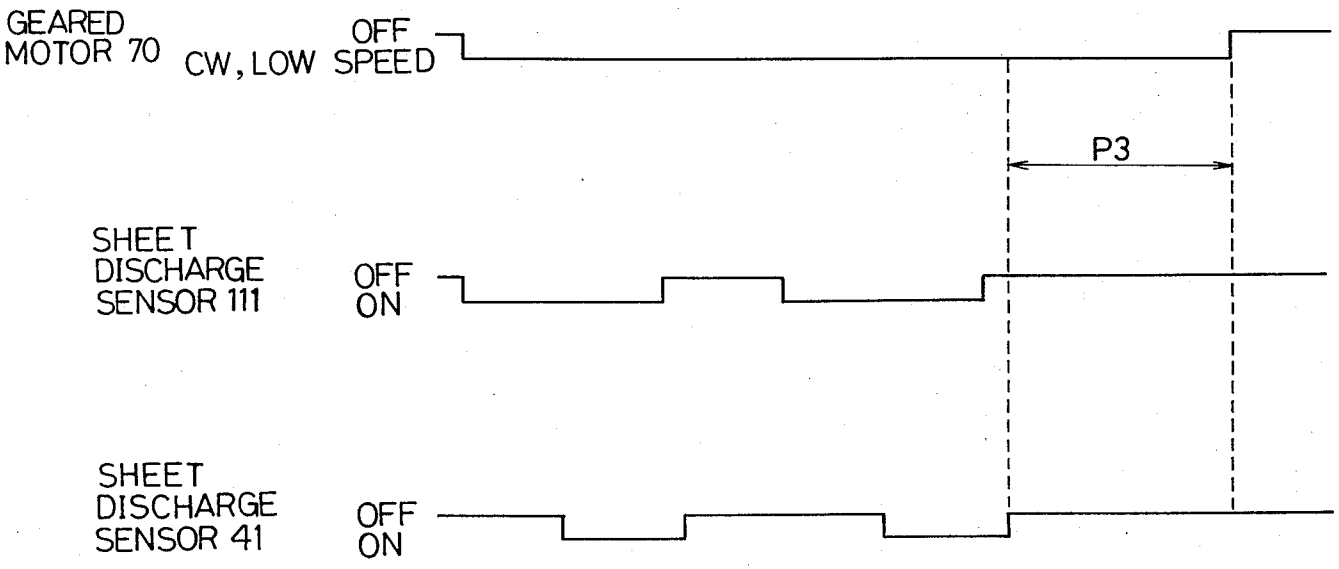
FIG. 11 is a face-up discharge mode timing chart.

After the sheet P has actuated the sheet discharge sensor 41, the sheet P is held between the feed-out driving rollers 43 and the following rollers 45 rotating at a fourth speed for a predetermined time P2 as shown in FIG. 11. Then, the geared motor 70 is stopped temporarily.

Next, the geared motor 70 is again rotated in the CW direction, at the first speed to rotate the forward-/reverse rotary driving rollers 29 in the CCW direction at the low speed (LOW). Now, the forward/reverse rotary driving rollers 29 are in stand-by state that they can take in the next sheet supplied out of the lower and upper sheet discharging rollers 109 and 110 of the printer main bodies 100.

In the stand-by state, the feed-out driving rollers 43 rotate in the CCW direction at a third speed, which is slower than the fourth speed, during the preceding sheet discharge. Hence, the rear end of the preceding sheet which is being discharged face-down is held between the forward/reverse rollers 29 and the following rollers 31, and the next sheet supplied out of the lower and upper sheet discharging rollers 109 and 110 is also held between the forward/reverse rotary driving rollers 29 and the following rollers 31.

As a result, the preceding sheet discharged face-down and the next sheet pass each other between the forward/reverse rotor driving rollers 29 and the following rollers 31. Thereby, the preceding sheet which is being discharged face-down is pulled out between the next sheet and the rollers 31, and discharged by the feed-out driving rollers 43 and the following rollers 45.

At this moment, the forward/reverse rotary driving rollers 29 are rotated in the CCW direction which is contrary to the direction discharging the preceding sheet. Therefore, the next sheet is delivered to the support frame 33 by the forward/reverse rotary driving rollers 29 while sliding under the preceding sheet.

Consequently, the sheet discharged out of the sheet discharge opening 39 is stored on the tray 47 with its face facing downwards (face-down). The above described operations are repeated to store successively discharged sheets in the order of an original document.

In addition, the geared motor 70 is turned off if the sheet discharge sensor 41 has been turned off, namely the next sheet is not supplied by the printer main body 100 after the preceding sheet has been discharged on the tray 47 and a predetermined time P3 has passed, i.e., in case the sheet discharge sensor 111 is not turned on.

(Face-up Discharge Mode)

A setting of the sheet storing apparatus for the face-up discharge mode is illustrated in FIG. 4. A face-up discharge mode timing chart is shown in FIG. 11.

The switching guides 23 are turned downwards as shown in FIG. 4 to switch the discharge mode to the face-up discharge mode for discharging the sheet P face-up (facing the image formed or copied surface upwards).

When the sheet P, copied by the printer main body 100, with its copied surface facing upwards and delivered through the lower and upper fixing rollers 107 and 108, is detected by the sheet discharge sensor 111, the geared motor 70 is started to rotate in the CW direction.

The speed of the forward/reverse rotary driving rollers 29 is controlled to the first speed, i.e., the low speed (LOW).

Then, the sheet P is guided to the upper surface of the switching guides 23, and introduced to the first delivery path 57. And the front end of the sheet P actuates the sheet discharge sensor 41.

The sheet discharge sensor 41 is checked whether it is turned on or off at the same time the discharge sensor 111 detects the rear end of the sheet. In the face-up mode, the sheet discharge sensor 41 is turned on when the discharge sensor 111 detects the rear end of the sheet P.

As a result, the sheet P is discharged by the feed-out driving rollers 43 and the following rollers 45 without changing the delivery speed, and stored on the tray 47 with its copied surface facing upwards.

In addition, the geared motor 70 is turned off if the sheet discharge sensor 41 has been turned off, namely the next sheet is not supplied by the printer main body 100 after the preceding sheet has been discharged on the tray 47 and a predetermined time P3 has passed, i.e., in case the sheet discharge sensor 111 is not turned on.

Electric charge removing brushes 60 (see FIGS. 3 or 4) are disposed on the downstream side of the following rollers 29 and 31 to prevent attraction between the preceding sheet which first enters the third delivery path 57 for face-down discharge and the next sheet which enters the third delivery path 57 after the preceding sheet.

Electric charge removing brushes 60 lift the sheet P's rear end, which will be the front end when moving backwards, by using the sheet's strength to avoid collision between the sheet P and the elastic sheet 51 and also serve to make the sheet P introduction to the third delivery path 27 for the face-down discharge easier.

Electric charge removing brushes 61 (See FIGS. 3 or 4.) disposed on the sheet discharge opening 39 remove electric charges so that the sheets P are stored sequentially in a well arranged manner. And the electric charge removing brushes 61 urge the sheet P downwards so that the rear end of the sheet P will not be left between the feed-out driving rollers 43 and the following rollers 45.

The above mentioned sheet storing apparatus according to the present invention immediately increases the sheet delivery speed of the forward/reverse rotary driving rollers 29 in the CCW direction when the sheet P has been discharged out of the printer main body 100, namely its rear end has been detected by the sheet discharge sensor 111. Then, the sheet storing apparatus decreases the speed of the forward/reverse rotary driving rollers 29 after the sheet P has been moved backwards and held between the feed-out driving rollers 43 and the following rollers 45. And then, the sheet storing apparatus immediately increases the speed of the forward/reverse rotary driving rollers 29 and the following rollers 31 after the next sheet has been released from the lower and upper sheet discharging rollers 109 and 110. Consequently, an interval between the preceding sheet and the next sheet can be enlarged, and during the sheet discharge, the preceding sheet can be discharged at a low speed. Accordingly, the sheets P discharged on the tray 47 can be stored in the well arranged manner.

Furthermore, the sheet storing apparatus selects the face-up discharge mode if the sheet P, supplied by the printer main body 100, is detected by the sheet discharge sensor 41 after the sheet P has been introduced to the first delivery path 57 and detected by the sheet discharge sensor 41. And the sheet storing apparatus selects the face-down discharge mode if the sheet P is not detected by the sheet discharge sensor 41. Consequently, it is not necessary to install a micro switch, etc. on the switching guide 23. The discharge mode selection can be done only by checking whether the sheet discharge sensor 41 has detected the sheet P or not. Accordingly, the sheet P is introduced to a selected delivery path even if the switching lever (not shown) is placed halfway. In other words, a wrong discharge program will not be selected because a desired discharge program is selected according to either on or off state of the sheet discharge sensor 41. In addition, it is possible to switch the discharge mode even during the successive sheet discharge because the discharge mode is checked by every sheet by the sheet discharge sensor 41.

In the above described preferred embodiment, the first speed of the forward/reverse rotary driving rollers 29 is equal to the third speed of the feed-out driving rollers 43, and the second speed of the forward/reverse rotary driving rollers 29 is equal to the fourth speed of the feed-out driving rollers 43, but the sheet storing apparatus according to the present invention is not limited to these settings. The speed of the feed-out driving rollers 43 may be faster than that of the forward-/reverse rotary driving rollers 29. Here, it is possible to vary the above mentioned speeds by changing power transmission gear ratio between the geared motor 70 and the forward/reverse rotary driving rollers 29, and between the forward/reverse rotary rollers 29 and the feed-out driving rollers 43, in case the forward/reverse rotary driving rollers 29 and the feed-out driving rollers 43 are driven by a single geared motor 70.

In the above described preferred embodiment, the sheet delivery speed of the forward/reverse rotary driving rollers 29 and the sheet delivery speed of the lower and upper sheet discharging rollers 109 and 110 are set to be equal to avoid damages to the sheet and skewing sheets until the sheet P rear end has been detected by the sheet discharge sensor 111. The functions and effectiveness can also be fully achieved by setting the sheet delivery speed of the forward/reverse rotary driving rollers 29 faster than the lower and upper sheet discharging rollers 109 and 110.

In the above described preferred embodiment, the sheet delivery speed of the forward/reverse rotary driving rollers 29 and the sheet delivery speed of the feed-out driving rollers 43 are increased immediately when the sheet P rear end has been detected by the sheet discharge sensor 111. But a control with a slight time lag may be performed, for instance, the above mentioned sheet delivery speeds may be increased after a predetermined time has passed. Since the sheet P rear end is detected by the sheet discharge sensor 111.

In the above described preferred embodiment, the sheet discharge sensor 41 is immediately checked whether it is turned on or off when the sheet P rear end is detected by the sheet discharge sensor 111. However, the sheet storing apparatus according to the present invention is not limited to this setting. The sheet discharge sensor 41's on or off state may be checked before the sheet P rear end detection by the sheet discharge sensor 111, to put it differently, after a predetermined time has passed since the sheet P front end detection by the sheet discharge sensor 111 or after the geared motor 70 is rotated for a predetermined time. The settings can be selected as desired.

In the above described preferred embodiment, the discharge mode switching with the switching guides 23 is performed manually. However, the discharge mode switching may be automatically switched by using a motor, a solenoid, etc.

Finally, in the above described preferred embodiment, the sheet storing apparatus is illustrated as an application for turning the sheet having one image formed surface. However, the sheet storing apparatus according to the present invention can be applied for turning a sheet having two image formed surfaces.

It is obvious that the sheet storing apparatus according to the present invention may be modified unless the purposes of the present invention are altered.

Having now fully described the invention, it will be apparent to one of ordinary skill in the art that many changes and modifications can be made thereto without departing from the spirit or scope of the invention as set forth herein.

What is claimed is:

1. A sheet storing apparatus, comprising:

a forward/reverse rotary member for taking in a sheet supplied by a sheet supplying member of an image forming apparatus and for delivering the sheet taken in with their formerly rear ends turned into the front ends;

a sheet discharging rotary member for discharging the sheet;

a sheet guide member for guiding the sheet delivered by said forward/reverse rotary member toward said sheet discharging rotary member;

a storage unit for storing the sheet discharged by said sheet discharging rotary member;

means for driving said forward/reverse rotary member and said sheet discharging rotary member; and means for controlling said drive means; wherein:

said forward/reverse rotary member is rotated at a first speed to take in the sheet supplied by the sheet supplying rotary member, and when the rear end of the sheet has been released from said sheet supplying rotary member, said forward/reverse rotary member is rotated at a second speed which is faster than the first speed, and when the rear end of the sheet has reached a predetermined position, the forward/reverse rotary member is rotated in the reverse direction at the second speed to have said sheet discharging rotary member rotating at a fourth speed hold the sheet to discharge the sheet, and the speed of said sheet discharging rotary member is decreased from the fourth speed to a third speed which is slower than the fourth speed, and then the speed of the forward/reverse rotary member is restored to the first speed to enable the forward/reverse rotary member to take in the next sheet supplied out of said sheet supplying rotary member.

2. The sheet storing apparatus of claim 1, wherein said third and fourth speeds of the sheet discharging rotary member are equal to or faster than said first and second speeds of the forward/reverse rotary member, respectively.

3. The sheet storing apparatus of claim 1, wherein said first speed of the forward/reverse rotary member is equal to or faster than said sheet supplying rotary member.

4. The sheet storing apparatus of claim 1, wherein said forward/reverse rotary member is rotated at the second speed which is faster than the first speed and said sheet discharging rotary member is rotated at the fourth speed which is faster than the third speed at the same time the rear end of the sheet has been released from said sheet supplying member, or after the rear end of the sheet has been released from said sheet supplying member and a predetermined time has passed.

5. A sheet storing apparatus, comprising:

a first delivery path including a pair of opposite surfaces for guiding a sheet, supplied by an image forming apparatus, in a first direction;

a second delivery path including a pair of opposite surfaces for guiding a sheet, supplied by said image forming apparatus, in a second direction;

switching means for selectively introducing the sheet, supplied by said image forming apparatus, either to said first delivery path or said second delivery path;

a forward/reverse rotary member disposed on the second delivery path downstream with respect to the sheet delivery direction which can selectively deliver the sheet, supplied by said image forming apparatus, either in a direction leaving said image forming apparatus behind or in a direction contrary to the former;

a third delivery path including a pair of opposite surfaces for guiding a sheet, delivered in the direction contrary to the direction leaving said image forming apparatus behind, to the first path;

first support means for integrally supporting one of said pair of opposite guide surfaces of said first delivery path, one of said pair of opposite guide surfaces of said second delivery path, and one of said pair of opposite guide surfaces of said third delivery path;

second support means for integrally supporting the other of said pair of opposite guide surfaces of said first delivery path, the other of said pair of opposite guide surfaces of said second delivery path, and the other of said pair of opposite guide surfaces of said third delivery path; and a swing mechanism for making said first and second support means relatively swingable away from each other to expose said first, second and third paths, 6. A sheet storing apparatus comprising:

a forward/reverse rotary member which can selectively deliver a sheet either in a direction leaving an image forming apparatus behind or in a direction contrary to the former, a second delivery path for introducing the sheet by said forward/reverse rotary member in the direction leaving said image forming apparatus behind, a third delivery path for guiding the sheet, delivered by said forward/reverse rotary member in a direction contrary to the direction leaving said image forming apparatus behind, to a third direction which is different from said two directions, and a sheet discharging member for delivering the sheet, introduced to said third delivery path by said forward/reverse rotary member, in the third direction wherein:

the sheet delivery force induced by said sheet discharging member is set to be greater than the sheet delivery force induced by said forward/reverse rotary member.

7. A sheet storing apparatus of claim 6 wherein a relative coefficient of friction between said forward-/reverse rotary member and the sheet is set to be greater than a relative coefficient of friction between the sheets.

8. A sheet storing apparatus for discharging sheets, supplied by an image forming apparatus, out of a discharge opening and storing the sheets with their image formed or copied surfaces either facing upwards or turning downwards on a storage unit, comprising:

a face-up discharge path for discharging the sheets out of said discharge opening with their image formed or copied surfaces facing upwards;

a face-down discharge path jointed with said face-up discharge path for discharging the sheets out of said discharge opening with their image formed or copied surfaces turning downwards;

sheet transport means for transporting the sheets along said paths;

control means for controlling said sheet transport means in a face-up mode wherein the sheets are introduced to said face-up discharge path, and in a face-down mode wherein the sheets are introduced to said face-down discharge path and are transported along said face-down discharge path;

switch means, manually operated by an operator, for selectively diverting and introducing the sheets supplied by the image forming apparatus either to said face-up discharge path or the face-down discharge path;

detecting means for detecting into which path the sheets supplied by the image forming apparatus are introduced; and selecting means for selecting one of said face-up mode and face-down mode of the control means in accordance with said detecting means.

9. The sheet storing apparatus of claim 8, wherein said detecting means includes a sheet sensor provided in a common path formed by joining said face-up discharge path and said face-down discharge path.

10. The sheet storing apparatus of claim 9, wherein said selecting means selects said face-up mode if the sheets supplied by the image forming apparatus are detected by said sheet sensor at a predetermined time and selects said face-down mode if the sheets are not detected by said sheet sensor at the predetermined time.

11. The sheet storing apparatus of claim 8, wherein said sheet transport means comprises a forward/reverse rotary member provided in said face-down discharge path.

12. The sheet storing apparatus of claim 8, wherein said switch means is electrically distinct from the control means.

* * * * *